US005810954A

United States Patent [19]

Jacobs et al.

[11] Patent Number: 5,810,954

[45] Date of Patent: Sep. 22, 1998

[54] METHOD OF FORMING A FINE FIBER BARRIER FABRIC WITH IMPROVED DRAPE AND STRENGTH OF MAKING SAME

[75] Inventors: Rob Lee Jacobs, Woodstock; David Craige Strack, Canton; Terry Kramer Timmons, Marietta, all of Ga.

[73] Assignee: Kimberly-Clark Worldwide, Inc., Neenah, Wis.

[21] Appl. No.: 603,941

[22] Filed: Feb. 20, 1996

[51] Int. Cl.[6] ..... D04H 1/06; D04H 1/54; D04H 1/56; D04H 1/72

[52] U.S. Cl. ..... 156/62.4; 156/229; 156/308.2

[58] Field of Search ..... 156/62.4, 229, 156/308.2

[56] References Cited

U.S. PATENT DOCUMENTS

| | | | |
|---|---|---|---|
| 2,736,676 | 2/1956 | Frickert, Jr. . | |
| 3,338,992 | 8/1967 | Kinney | 264/24 |
| 3,341,394 | 9/1967 | Kinney . | |
| 3,406,033 | 10/1968 | Reitz . | |
| 3,408,709 | 11/1968 | Reitz | 26/51 |
| 3,427,376 | 2/1969 | Dempsey | 264/282 |
| 3,474,509 | 10/1969 | Bray | 26/51 |
| 3,502,538 | 3/1970 | Petersen . | |
| 3,502,763 | 3/1970 | Hartmann | 264/210 |
| 3,542,615 | 11/1970 | Dobo et al. | 156/181 |
| 3,692,618 | 9/1972 | Dorschner et al. . | |
| 3,802,817 | 4/1974 | Matsuki et al. | 425/66 |
| 3,849,241 | 11/1974 | Butin et al. . | |
| 3,914,501 | 10/1975 | Miller et al. | 428/296 |
| 4,041,203 | 8/1977 | Brock et al. | 428/157 |
| 4,075,383 | 2/1978 | Anderson et al. | 428/198 |
| 4,088,731 | 5/1978 | Groome | 264/282 |
| 4,107,364 | 8/1978 | Sisson | 428/196 |
| 4,154,885 | 5/1979 | Tecl et al. | 428/198 |
| 4,340,563 | 7/1982 | Appel et al. | 264/518 |
| 4,374,888 | 2/1983 | Bornslaeger | 428/198 |
| 4,443,513 | 4/1984 | Meitner et al. | 422/195 |
| 4,622,259 | 11/1986 | McAmish et al. | 428/171 |
| 4,965,122 | 10/1990 | Morman | 428/225 |
| 4,981,747 | 1/1991 | Morman | 428/198 |
| 5,057,357 | 10/1991 | Winebarger | 428/195 |
| 5,108,820 | 4/1992 | Gessner | 428/219 |
| 5,114,781 | 5/1992 | Morman | 428/198 |
| 5,169,706 | 12/1992 | Collier, IV et al. | 428/152 |
| 5,296,289 | 3/1994 | Collins | 428/296 |
| 5,336,552 | 8/1994 | Strack et al. | 428/224 |
| 5,382,400 | 1/1995 | Pike et al. | 264/168 |
| 5,413,811 | 5/1995 | Fitting et al. | 427/176 |
| 5,482,765 | 1/1996 | Bradley et al. | 428/286 |

FOREIGN PATENT DOCUMENTS

| | | | |
|---|---|---|---|
| 0 416 620 | 3/1991 | European Pat. Off. | B32B 5/26 |
| 0 602 613 | 6/1994 | European Pat. Off. | D04H 1/56 |
| 0 685 579 | 12/1995 | European Pat. Off. | D01F 8/06 |

*Primary Examiner*—James C. Cannon
*Attorney, Agent, or Firm*—James B. Robinson; William D. Herrick

[57] ABSTRACT

A method of producing a fabric comprising producing fine denier fibers, using either meltblown or spunbond processes, or a combination of the two, followed by crimping, spot-bonding using differential bond roll temperatures, and neck-stretching. Fiber having less than or equal to about 1.5 denier is preferred. The bond temperature differential is about 10°–50° F. The mat produced has the unexpected result of improved strength, conformability and reduced stiffness.

49 Claims, 2 Drawing Sheets

METHOD OF FORMING A FINE FIBER BARRIER FABRIC WITH IMPROVED DRAPE AND STRENGTH OF MAKING SAME

FIELD OF THE INVENTION

The present invention relates generally to a non-woven fabric mat having improved drape, strength, softness, and other properties; and, a method for producing the mat. The method of the invention provides for, in a preferred embodiment, forming crimped fine denier fibers by a spunbond process, producing a mat therefrom, spot bonding the mat using an anvil and a pattem bond roll where the rolls are at different temperatures, and stretching the mat.

BACKGROUND OF THE INVENTION

Processes for manufacturing nonwoven fabrics have become a highly developed area of industry. Nonwoven fabrics have become more advanced and have a wide variety of applications, from baby wipes and diapers to surgical garments, automobile and ground covers. Diversity of use has caused evolution and sophistication of the processes which create different effects and characteristics of the fabrics.

Strength and drapeability are among the main physical properties which scientists seek to optimize. The physical characteristics of the fiber itself, e.g., chemical composition, conjugate agents, and diameter, have certain effects on the nonwoven fabric formed therefrom. Softness and drape of a fabric, important for garment and other applications, are critically impacted by the bending modulus of the fabric. The bending modulus of a knit or woven fabric is not significantly affected by the thickness of the woven matrix, but is principally dependent on the flexural rigidity of the composing fiber, according to the relationship:

$$\text{flexural rigidity} = \frac{E\pi R^4}{4}$$

where E=polymer modulus and R=fiber diameter.

Therefore, a round fiber of smaller diameter (finer denier) should result in a much more drapeable material. This is the case for woven and knit fabrics, however, this does not hold for spot bonded nonwovens, comprised at least in part of spunbond material. This is due to several factors, e.g., where the bonded areas act as low density slabs, where bending modulus is dependent on thickness by the relationship:

$$\text{flexural rigidity} = \frac{Et^4}{4}$$

where t=thickness of the bonded region.

The bending modulus of the unbonded region is dependent on the ratio of fibers which are free-to-move versus those that are not. At the extremes (fibers all free or all not-free) the bending rigidity of the unbonded regions will differ by 4–6 orders of magnitude. The greater the freedom of movement the lower the bending rigidity of the nonwoven. The freedom of unbonded fibers is especially important as the bonded regions occupy only 12–19% of the matrix in certain samples. Generally, though, a finer denier fiber produces a stiffer bonded fabric than a larger denier fiber. The loss of freedom of movement with decreasing denier is largely attributed to the exponential increase in number of fibers per unit area. This translates to more fibers held taut between bond points and greater entanglement. As an example, a web comprised of 1.5 dpf fibers has four times as many fibers as a comparably sized web comprised of 3.0 dpf fibers.

The aforementioned properties of the fabric can be altered by additional processing techniques, generally known in the art and which have generally anticipated results. For example, increasing fiber freeness in the unbonded areas of a spot bonded, finer denier, spunbond mat, by crimping the individual fibers significantly improves conformability, as measured by cup crush, by reducing the "straightness" of the fibers between bond points. The tensile strength of the mat is correspondingly decreased, as well, however, because of the reduction in fibers held taut between bond points and some reduction in bonding efficiency in the lower density webs.

Fiber freeness can be additionally enhanced by stretching the post-bonded mat, which pulls weakly held fibers away from bond points, breaks fiber-to-fiber bonds between bond points, and increases loft between bond points, thus loosening the otherwise tightly packed fine fiber matrix.

Spot bonding of fine fiber or microfiber nonwovens (e.g., polyolefin with <2.0 denier), utilizing a pattern and anvil technique, results in a primary bond corresponding to the raised portion of the pattern roll, and secondary fiber-to-fiber bonds between bond points, principally on the anvil side. The presence of secondary bonds, although weaker than the primary bonds, reduces fiber freeness, significantly stiffening the mat. It would be desirable to have a process whereby spotbonding can be employed, yet fiber freeness would not be significantly reduced, compared to current methods. Fabric designers frequently desire a fabric having increased strength and improved conformability (drapeability). The combination of crimping and spotbonding processes has heretofore not produced such a desired fabric. Chemical softening agents known in the art can be added during the fabric forming process, but tend to reduce strength and increase manufacturing costs.

Heretofore, however, these techniques have not been used collectively, perhaps because the anticipated effects of particular techniques would lead to undesirable resulting properties. Many of these techniques have known operating parameter windows which would normally lead one skilled in the art to assume that combining the techniques would not produce a synergistically positive outcome. It would be desirable to produce a fabric from a fine denier fiber having improved strength and conformability without the accompanying stiffness which would be anticipated by using fine denier fiber. Such a fabric would have particular applicability with laminate fabric structures, such as with spunbond-meltblown-spunbond composite fabrics.

BACKGROUND OF THE ART

A number of patents have issued in the general area of the present invention.

U.S. Pat. No. 5,413,811, issued to Fitting et al., and commonly assigned to the assignee of the present invention, describes a combination of chemical softening and mechanical stretching processes which produce a nonwoven mat having a softer hand.

U.S. Pat. No. 5,296,289, issued to Collins, discloses spotbonding and axial stretching processes.

U.S. Pat. No. 5,057,357, issued to Winebarger, describes a method of forming a nonwoven fibrous mat incorporating a paftemed roller and a smooth roller, the rollers being at different temperatures. A second pair of rollers is used, which can have a second pattem.

U.S. Pat. No. 4,443,513, issued to Meitner et al., and commonly assigned to the assignee of the present invention, teaches a meltblown mat using thermal bond rolls and stretching the mat. The fabric produced has improved softness, bulk and drapeability while retaining strength.

None of these patents discloses or suggests how to combine processes to produce a nonwoven fabric using fine denier fiber which has improved strength, reduced stiffness and improved drapeability. Under normal conditions one skilled in the art would expect the result of using a fine denier fiber to be increased stiffness. The prior art would lead one to expect that the result of decreasing fiber denier and employing softening techniques would be decreased strength.

Accordingly, it is a principal object of the present invention to provide a method of producing a nonwoven fabric having improved strength, softness (tactile properties) and conformability.

It is a further object of the present invention to provide a method of producing a nonwoven fabric using a fine denier fiber while maintaining drapeability and improving strength.

Other objects, features, and advantages of the present invention will become apparent upon reading the following detailed description of embodiments of the invention, when taken in conjunction with the accompanying drawing and the appended claims.

SUMMARY OF THE INVENTION

The objects of the present invention are achieved by providing a method of forming a nonwoven fabric, comprising, (a) providing at least one polymer resin capable of forming fibers; (b) forming a plurality of fine denier fibers or microfibers from the resin; (c) crimping the fibers; (d) forming a nonwoven fiber mat from the fibers; (e) spot bonding the mat by passing said mat between a pair of bond rolls; and, (f) neck stretching the mat. The fibers are preferably less than about 1.5 dpf. Spotbonding uses two rolls heated to different temperatures, through which passes the formed mat. The temperature differential used depends on the fabric denier used and raw material composition but is desirably between about 10° and 50° F. (5° and 28° C.) or still more desirably between about 15° and 45° F. (8° and 25° C.). Preferably, the temperature differential is about 40° F. (22° C.) for polypropylene and random copolymer (ethylene in propylene) homofibers.

In a preferred embodiment a laminate of spunbond-meltblown-spunbond fiber layers is formed wherein the spunbond layers.are composed of fine denier fibers that have been crimped. The formed laminate is then passed between a pair of heated nipped thermal bond rolls comprising a smooth anvil roll and a pattem roll, whereby the temperature differential between the two rolls is in the range of about 15°–45° F. (8°–25° C.), controllable depending on the characteristics of the fabric and conveyor speed. In all embodiments, the pattern roll is set to the higher temperature. After passing through the thermal bond rolls the fabric is neck stretched in the machine direction, followed by widening (unnecking) in the cross direction. The completed fabric is wound onto parent rolls for uptake and storage.

TEST METHODS

Figure 1:
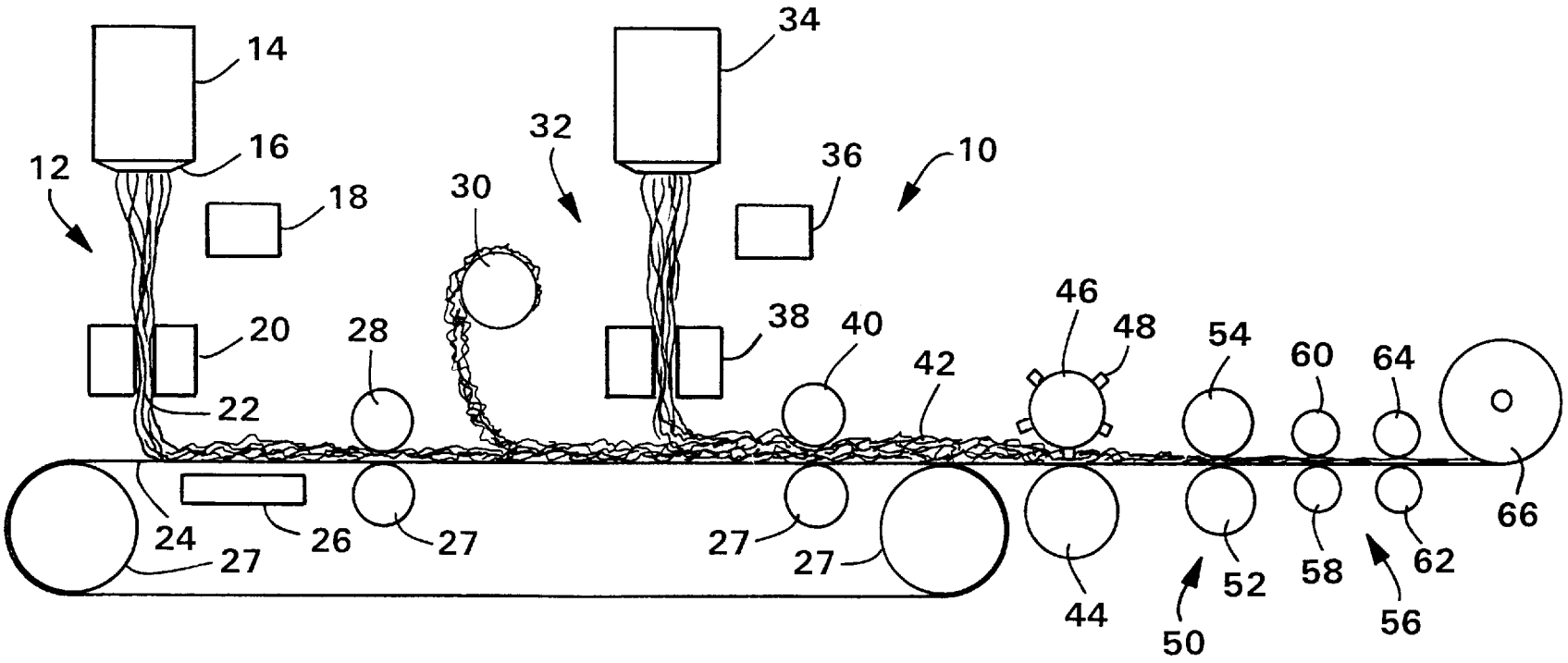
FIG. 1 shows a side elevation view of an apparatus of a preferred embodiment of the present invention in which a laminate of spunbond-meltblown-spunbond fibers is made.

Cup Crush: The conformability and drapeability of a nonwoven fabric may be measured according to the "cup crush" test. The cup crush test evaluates the fabric by measuring the peak load and energy required for a 4.5 cm diameter hemispherically shaped foot to crush a 23 cm by 23 cm piece of fabric shaped into an approximately 6.5 cm diameter by 6.5 cm tall inverted cup while the cup shaped fabric is surrounded by an approximately 6.5 cm diameter cylinder to maintain a uniform deformation of the cup shaped fabric. An average of ten readings is used. The foot and the cup are aligned to avoid contact between the cup walls and the foot which could affect the reading. The cup crush load is measured while the foot is descending at a rate of about 0.25 inches per second (380 mm per minute) and is measured in grams. The cup crush energy is the total energy required to crush a sample which is the total energy from the start of the test to the peak load point, i.e., the area under the curve formed by the load in grams on one axis and the distance the foot travels on the other. Crush energy is, therefore, reported in gram-millimeters.

Lower cup crush values indicate a more drapeable and comfortable laminate. A suitable device for measuring cup crush is a model FTD-G-500 load cell (500 gram range) available from the Schaevitz Company, Pennsauken, N.J.

Grab Tensile test: The grab tensile test is a measure of breaking strength and elongation or strain of a fabric when subjected to unidirectional stress. This test is known in the art and conforms to the specifications of Method 5100 of the Federal Test Methods Standard No. 191A. The results are expressed in pounds to break and percent stretch before breakage. Higher numbers indicate a stronger, more stretchable fabric. The term "load" means the maximum load or force, expressed in units of weight, required to break or rupture the specimen in a tensile test. The term "strain" or "total energy means the total energy under a load versus elongation curve as expressed in weight-length units. The term "elongation" means the increase in length of a specimen during a tensile test. Values for grab tensile strength and grab elongation are obtained using a specified width of fabric, usually 4 inches (102 mm), clamp width and a constant rate of extension. The sample is wider than the clamp to give results representative of effective strength of fibers in the clamped width combined with additional strength contributed by adjacent fibers in the fabric. The specimen is clamped in, for example, an Instron Model TM, available from the Instron Corporation, 2500 Washington St., Canton, Mont. 02021, or a Thwing-Albert Model INTELLECT II available from the Thwing-Albert Instrument Co., 10960 Dutton Rd., Philadelphia, Pa. 19154, which have 3 inch (76 mm) long parallel clamps. An average of ten readings is used. This closely simulates fabric stress conditions in actual use.

DESCRIPTION OF THE INVENTION

As used herein the term "meltblown fibers" means fibers formed by extruding a molten thermoplastic material through a plurality of fine, usually circular, die capillaries as molten threads or filaments into converging high velocity gas (e.g., air) streams which attenuate the filaments of molten thermoplastic material to reduce their diameter, which may be to microfiber diameter. Thereafter, the meltblown fibers are carried by the high velocity gas stream and are deposited on a collecting surface to form a mat of randomly dispursed meltblown fibers. Such a process is disclosed, for example, in U.S. Pat. No. 3,849,241 to Buntin.

Meltblown fibers are microfibers which may be continuous or discontinuous, are generally smaller than 10 microns in average diameter, and are generally tacky when deposited onto a collecting surface.

As used herein the term "microfibers" means fibers having a denier of less than about 1.0 dpf ("denier per filament"). Denier is defined as grams per 9000 meters of a fiber and may be calculated as fiber diameter in microns squared, multiplied by the density in grams/cc, multiplied by 0.00707. A lower denier indicates a finer fiber and a higher denier indicates a thicker fiber for materials of similar density. For example, the diameter of a polypropylene fiber given as 15 microns may be converted to denier by squaring, multiplying the result by 0.89 g/cc and multiplying by 0.00707.

Thus, a 15 micron polypropylene fiber has a denier of about 1.42 ($15^2 \times 0.89 \times 0.00707 = 1.416$). Outside the United States the unit of measurement is more commonly the "tex", which is defined as the grams per kilometer of fiber. Tex may be calculated as denier/9.

As used herein, the terms "necking" or "neck stretching" interchangeably refer to a method of elongating a nonwoven fabric, generally in the machine direction, to reduce its width in a controlled manner to a desired amount. The controlled stretching may take place under chilled, ambient, or elevated temperatures and is limited to an increase in overall dimension in the direction being stretched up to the elongation required to break the fabric. When relaxed, the mat retracts toward its original dimensions. Such a process is disclosed, for example, in U.S. Pat. No. 4,443,513 to Meitner and Notheis and U.S. Pat. Nos. 4,965,122, 4,981,747 and 5,114,781 to Morman.

As used herein the term "neck softening" means neck stretching carried out without the addition of heat to the material as it is stretched in the machine direction. In neck stretching or softening, a fabric is referred to, for example, as being stretched by 20%. This means it is stretched in the machine direction until its length is 120% of its original unstretched length.

As used herein, the term "neckable material" means any material which can be necked.

As used herein, the term "unnecking" means a process applied to a reversibly necked material to extend it to at least its original, pre-necked dimensions by the application of a stretching force in a direction generally perpendicular to the direction of stretch, which causes it to recover at least 50 percent of the dimentional loss from the original machine direction necking upon release of the stretching force.

As used herein, the term "necked material" refers to any material which has been constricted in at least one dimension by processes such as, for example, drawing whereby the constriction is generally perpendicular to the direction of drawing.

As used herein the term "polymer" generally includes but is not limited to, homopolymers, copolymers, such as for example, block, graft, random and alternating copolymers, terpolymers, etc., and blends and modifications thereof. Furthermore, unless otherwise specifically limited, the term "polymer" shall include all possible geometrical configuration of the material. These configurations include, but are not limited to isotactic, syndiotactic and random symmetries.

The fabric of this invention may be a multilayer laminate. An example of a multilayer laminate is an embodiment wherein some of the layers are spunbond and some meltblown such as a spunbond-meltblown-spunbond (SMS) laminate as disclosed in U.S. Pat. No. 4,041,203 to Brock et al., U.S. Pat. No. 5,169,706 to Collier, et al, and U.S. Pat. No. 4,374,888 to Bomslaeger. Such a laminate may be made by sequentially depositing onto a moving forming belt first a spunbond fabric layer, then a meltblown fabric layer and last another spunbond layer and then bonding the laminate in a manner described below. Alternatively, one or more of the fabric layers may be made individually, collected in rolls, and combined in a separate bonding step. Such fabrics usually have a basis weight of from about 0.1 to 12 osy (3 to 400 gsm), or more particularly from about 0.30 to about 3 osy.

The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91).

As used herein the term "spunbonded fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,502,538 to Levy, and U.S. Pat. No. 3,542,615 to Dobo et al. Spunbond fibers are generally not tacky when they are deposited onto a collecting surface. Spunbond fibers are generally continuous and have average diameters (from a sample of at least ten fibers) larger than 7 microns, more particularly, between about 10 and 30 microns.

As used herein the term "conjugate fiber" refers to fibers which have been formed from at least two polymers extruded from separate extruders but spun together to form one fiber. Conjugate fibers are also sometimes referred to as multicomponent or bicomponent fibers. The polymers are usually different from each other though conjugate fibers may be monocomponent fibers. The polymers are arranged in substantially constantly positioned distinct zones across the cross-section of the conjugate fibers and extend continuously along the length of the conjugate fibers. The configuration of such a conjugate fiber may be, for example, a sheath/core arrangement wherein one polymer is surrounded by another or may be a side by side arrangement or an "islands-in-the-sea" arrangement. Conjugate fibers are taught in U.S. Pat. No. 5,108,820 to Kaneko et al., U.S. Pat. No. 5,336,552 to Strack et al., and U.S. Pat. No. 5,382,400 to Pike et al. For two component fibers, the polymers may be present in ratios of 75/25, 50/50, 25/75 or any other desired ratios.

As used herein the term "compaction roll" means a set of rollers above and below the web to compact the web as a way of treating a just produced spunbond web in order to give it sufficient integrity for further processing, but not the relatively strong bonding of secondary bonding processes like through-air bonding, thermal point bonding and ultrasonic bonding. Compaction rolls slightly squeeze the web in order to increase its self-adherence and thereby its integrity.

As used herein the term "hot air knife" or "HAK" means a process of pre- or primarily bonding a just produced spunbond web in order to give it sufficient integrity for further processing similar to the function served by compaction rolls, but does not mean the relatively strong bonding of secondary bonding processes like through air bonding, thermal bonding and ultrasonic bonding. A hot air knife is a device which focuses a stream of heated air at a very high flow rate, generally about 1,000 to about 10,000 feet per minute (fpm) (305 to 3050 meters per minute), or more particularly, from about 3,000 to 5,000 feet per minute (915 to 1525 meters per minute) directed at the nonwoven web immediately after its formation. The air temperature is usually in the range of the melting point of at least one of the polymers used in the web, generally between about 200° and 550° F. (93° and 290° C.) for the thermoplastic polymers commonly used in spunbonding. The control of air temperature, velocity, pressure, volume and other factors helps avoid damage to the web while increasing its integrity. The HAK's focused stream of air is arranged and directed by at least one slot of about ⅛ to 1 inches (3 to 25 mm) in width, particularly about ⅜ inch (9.4 mm), serving as the exit for the heated air towards the web, with the slot running in a substantially cross-machine direction over substantially the entire width of the web. In other embodiments, there may be a plurality of slots arranged next to each other or separated by a slight gap. The at least one slot is usually, though not essentially, continuous, and may be comprised of, for example, closely spaced holes. The HAK has a plenum to distribute and contain the heated air prior to its exiting the slot. The plenum pressure of the HAK is usually between about 1.0 and 12.0 inches of water (2 to 22 mmHg), and the HAK is positioned between about 0.25 and 10 inches and more preferably 0.75 to 3.0 inches (19 to 76 mm) above the forming wire. In a particular embodiment the HAK plenum's cross sectional area for cross-directional flow (i.e., the plenum cross sectional area in the machine direction) is at least twice the total slot exit area. Since the foraminous wire onto which spunbond polymer is formed generally moves at a high rate of speed, the time of exposure of any particular part of the web to the air discharged from the hot air knife is less than a tenth of a second and generally about a hundredth of a second in contrast with the through air bonding process which has a much larger dwell time. The HAK process has a great range of variability and controllability of many factors such as air temperature, velocity, pressure, volume, slot or hole arrangement and size, and the distance from the HAK plenum to the web. More detailed information on the hot air knife process may be found in U.S. Pat. No. 5,707,468 issued Jan. 13, 1998, to Arnold et al.

DESCRIPTION OF THE PREFERRED EMBODIMENTS

The present invention provides a method of producing a fabric having the unexpected result of improving strength, drape, and conformability. The present invention is usable with meltblown or spunbond or a combination of the two or using other web forming processes known to those skilled in the art. In general, the method comprises producing a crimped, fine denier fiber, using either meltblown or spunbond processes, or a combination of the two, spotbonding using differential bond roll temperatures and neck-stretching. For purposes of the present description a laminate of spunbond-meltblown-spunbond fibers shall be discussed. It is to be understood that single layers, as well as other laminates and non-laminate fiber mat structures can be employed.

In a preferred embodiment of the present invention, fine denier fibers, in the range of from about 0.5 to about 3.0 dpf, preferably less than or equal to about 1.5 dpf, are produced by a spunbond process, as described above. The fibers are formed of resin which is preferably a thermoplastic polymer such as, but not limited to, polyolefins, polyesters, polyamides, polyurethanes, copolymers and mixtures thereof.

FIG. 1 shows an apparatus for manufacturing the mat according to the method of the present invention, in which apparatus 10 has an assembly 12 for producing spunbond fibers in accordance with known methods (also see U.S. Pat. No. 5,382,400 to Pike et al.). A spinneret 14 is supplied with molten polymer resin from a resin source (not shown). The spinneret 14 produces fine denier fibers from the exit 16, which are quenched by an air stream supplied by a quench blower 18. The air stream differentially cools one side of the fiber stream more than the other side, thus causing bending and crimping of the fibers. Crimping, as discussed in general hereinabove, creates a softer fabric by reducing the "straightness" of the fibers, between bond points created in the thermal bonding step, as well as fiber-to-fiber bonds. Various parameters of the quench blower 18 can be controlled to control the quality and quantity of crimping. Fiber composition and resin selection also determine the crimping characteristics imparted. In an alternative embodiment, conjugate fibers can be produced which have different crimping properties.

The filaments are drawn into a fiber drawing unit or aspirator 20 having a Venturi tube/channel 22, through which the fibers pass. The tube is supplied with temperature controlled air, which attenuates the filaments as they are pulled through the fiber drawing unit 20. The attenuated fibers are then deposited onto a foraminous moving collection belt 24 and retained on the belt 24 by a vacuum force exerted by a vacuum box 26. The belt 24 travels around guide rollers 27. As the fibers move along on the belt 24, a compaction roll 28 above the belt, which operates with one of the guide rollers 27 beneath the belt, compresses the spunbond mat so that the fibers have sufficient integrity to go through the manufacturing process.

Alternatively, instead of a compaction roll 28, a hot air knife can be used to compress the fibers. An advantage of using a hot air knife is that it reduces or eliminates the problem known in the art as "roll wrap," i.e., a following of the circumference of the compaction roll by all or part of the spunbond web, which can break the web if it wraps completely around the compaction roll. Also a hot air knife does not debulk the mat and avoids the stress that a compaction roll puts on the fibers. The hot air knife melts the surface of the fiber mat to a minor degree as it compresses the mat slightly, but the pressure and temperature can be controlled. Moreover, a hot air knife produces a superior result with a greater throughput speed than a compaction roll.

A layer of meltblown fibers, comprised of <1 $\mu$m to about 10 $\mu$m diameter, preferably less than 5 $\mu$m diameter, may be introduced on top of the spunbond layer from a windup roll 30 of previously manufactured meltblown fibers. Alternatively, it is also possible to form meltblown fibers and deposit them as formed directly on the spunbond layer. The meltblown fibers are formed of resin which is preferably a thermoplastic polymer such as, but not limited to, polyolefins, polyesters, polyamides, polyurethanes, copolymers and mixtures thereof.

A second layer of spunbond fibers is made by spunbond apparatus 32 in a manner similar to that described for spunbond apparatus 12; i.e., a spinneret 34 produces filaments which are quenched and crimped by a quench blower 36 and attenuated by an aspirator 38. The fibers deposited on the meltblown layer are then compressed by a second compaction device 40 to form a three layer laminate comprised of spunbond-meltblown-spunbond fibers 42 (the "SMS" laminate).

Spunbond nonwoven fabrics contemplated by the present invention are generally bonded in some manner as they are produced in order to give them sufficient structural integrity to withstand the rigors of further processing into a finished product. Bonding can be accomplished in a number of ways such as hydroentanglement, needling, ultrasonic bonding, adhesive bonding, stitchbonding, through-air bonding and thermal bonding. A preferred method is by thermal bonding. The SMS laminate 42 is moved off the belt 24 and passed between a nipped pair of thermal bond rolls 44 and 46. Bond roll 44 is a conventional smooth anvil roll. Bond roll 46 is a conventional pattern roll having a plurality of pins 48. The pins create bond points within the fabric matrix. The number and size of bond points are related to fabric stiffness; i.e., higher bond areas or more bond points per unit area produce a stiffer fabric. The SMS laminate is passed between the rolls 44 and 46 and the pins 48 imprint a pattern on the SMS laminate 42 by pressing on the anvil roll 44 where the nip pressure is controlled for uniformity.

The rolls 44 and 46 can be heated to more efficiently form fiber bonds. In a preferred embodiment, the rolls 44 and 46 are heated to different temperatures. The optimal temperature range and roll differential depends on the denier, fiber composition, web mass and web density and whether monocomponent or conjugate fibers are used. For monocomponent polypropylene fibers having approximately a 3 dpf, produced at about 500 feet per minute, the temperature range is about 270° F. (132° C.), to about 340° F. (171° C.), with a preferred differential between pattern and anvil roll of about 10° F. (5.5° C.) to about 30° F. (17° C.). For monocomponent polypropylene fibers having approximately a 1 dpf at the same production speed, the temperature range is about 240° F. (115° C.) to about 290° F. (143° C.), with a preferred differential of about 40°–50° F. (22°–28° C.). The overall temperature range is lower for smaller denier fibers because heat transfer is more efficient. For a given raw material, the temperature range stays generally the same, but shifts warmer or cooler, depending on conveyor speed which significantly impacts web mass and density. Preferably, the pattern roll is heated to a higher temperature than the anvil. The lower temperature on the anvil roll 44 reduces the possibility of fiber glazing and secondary fiber-to-fiber bonding between the bond points. The result of this differential bond roll temperature is that secondary fiber-to-fiber bonds are reduced without affecting the integrity of the primary bonds, therefore improving fabric drape.

After the laminate 42 passes through the bond rolls 44 and 46, it is passed to a neck stretching assembly 50, comprising a pair of nipped rolls 52 and 54. The rolls 52 and 54 run under tension at a controlled speed faster than the speed of the bond rolls 44 and 46, thus stretching the SMS laminate 42 in the same direction as the path of the fabric, known as the "machine direction." Neck stretching breaks fiber-to-fiber bonds and strains fibers between bond points, thereby reducing fabric stiffness. The rolls may be heated or cooled as needed to achieve desired mat properties and dimensional stability.

Figure 2:
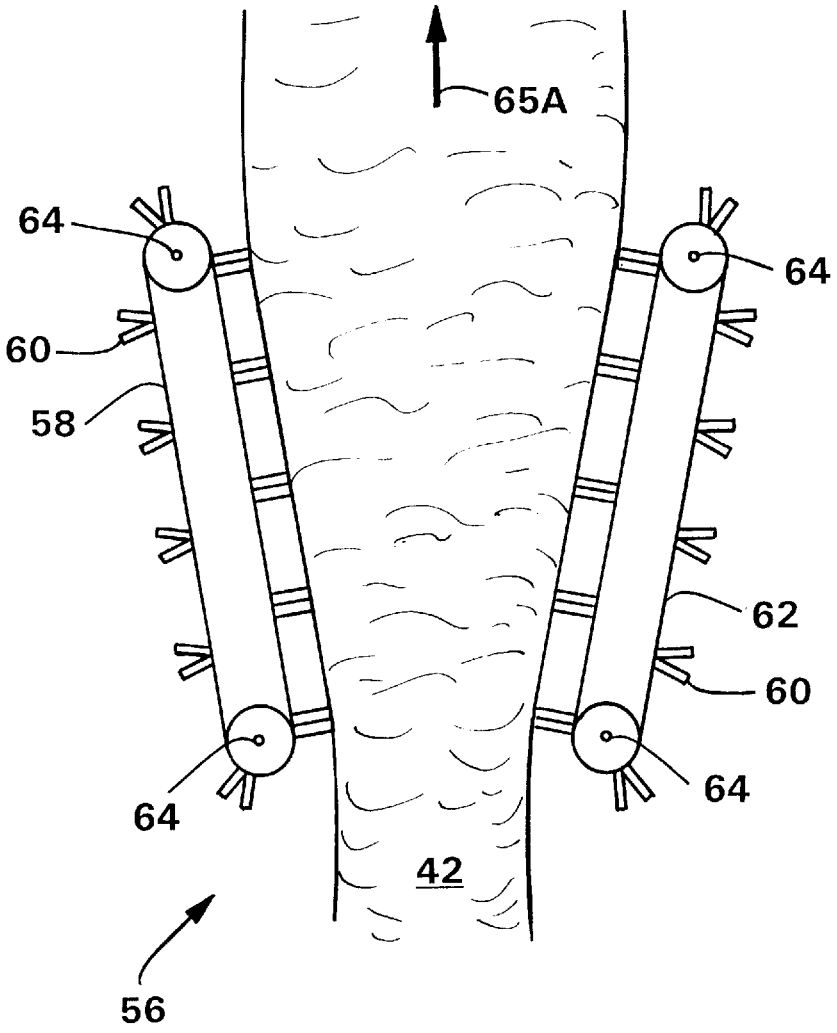
FIG. 2 shows a top view of an unnecking assembly detail of the apparatus of FIG. 1.

The neck stretched SMS laminate 42 is then passed to an unnecking assembly 56, comprising a Tenter frame, which is known to those skilled in the art. FIG. 2 shows a Tenter frame in which a chain 58 having a plurality of clips 60 attached to the chain links and spaced along the chain 58, and a chain 62 having clips 60 similarly spaced therealong. The chains 58 and 62 are actuated by gears 64 which are driven by a motor 65 (not shown). The chains 58 and 62 are not parallel, rather they diverge (from a top view) in the downstream direction (indicated by arrow 65A). As the laminate 42 approaches the assembly 56, the open clips 60 automatically and sequentially close and grip the edge of the laminate. As the chains 58 and 62 advance, the laminate 42 is stretched as the chain paths diverge. As the clips 60 reach the end of the top of the chain run, the clips automatically open, releasing the stretched laminate 42. The finished formed SMS laminate 42 is then wound onto a parent roll 66 for uptake and storage. Both necking and unnecking improve loft, thus increasing fiber freeness between bond points, therefore improving fabric drape. A substantial portion of the width lost during neck stretching is regained during unnecking, as well.

An unexpected result of the method of the present invention is that the combination of fine spunbond fibers (less than or equal to about 1.5 dpf) and improving fiber freeness by the techniques of crimped fiber, mechanical stretch softening, and differential bond roll temperatures allowed the production of an SMS fabric with improved drape at equal or higher strength than standard 3.0 denier mats. Drape improvements achieved with these techniques were additive in the tested ranges.

The invention will be further described in connection with the following examples, which are set forth for purposes of illustration only. Parts and percentages appearing in such examples are by weight unless otherwise stipulated.

EXAMPLES

EXAMPLE 1

Improved fabrics were demonstrated with a range of polyolefin raw materials with both homofiber and conjugate spunbond (SB) filaments. The example described below utilized a 3.5% random copolymer of ethylene and propylene, available as Exxon 9355 grade from Exxon Chemical, Baytown, Tex., which provided a preferred crimp in a homofiber polyolefin system.

An improved clothlike spunbond fabric was produced with continuous round microfibers from a plurality of spinnerets at a denier of 0.95 g/9000 m. During the research a denier range from 4.0 to 0.9 was investigated and a minimum capability of 0.7 g/9000 m has been demonstrated with the same process and polymer systems. These fibers were drawn pneumatically through an isolated quench air cross-flow zone and deposited randomly on a permeable conveyer. Quench flow, temperature, direction and profile within the spinline were varied along with pneumatic drawing variables to provide the desired level of fiber crimping. Melt temperature and quench delay zone depth were also modified to optimize crimp fiber characteristics. The distance from the exit of the pneumatic drawing device to the permeable conveyor was optimized for strength and drapeability of the spunbond mat. The resulting mat was compacted and combined with a barrier layer comprised of less than about 1 and up to about 5 micron diameter meltblown fibers. The fibers were polypropylene 0.5 osy high melt flow resin granules (melt flow rate was at 230° C.) available as Exxon 3495G grade from Exxon Chemical, Baytown, Tex. The two layers were then combined with a third layer comprised of a continuous filament SB mat of the nature previously described and then transferred to a bonding step. Basis weights of the three components were individually varied through a range of 0.15 to 1.2 ounces/sq. yd (osy) during the development and compared against each of the principal performance criteria of cup crush and grab tensile.

The crimp of the continuous SB fibers can be described as in the range of 30–300 crimps per inch (i.e. rotations of the helical structure of the crimp and having an amplitude (diameter of the helical spiral) of 0.030–0.200 inches. The full range of crimp investigated during the trials was 20–1000 crimps/inch and an amplitude of 0.020 to 0.250 inches. Crimp was found to be directionally proportional to the drape of the laminate, i.e. the lowest amplitude and highest number of crimpsanch produced the most drapeable mats. Crimp, however, reduced strength (stress curve properties) at higher levels even though strain properties were generally enhanced. Total Tensile Energy, the area under the stress/strain curve, was also reduced as crimp level increased.

Bonding was accomplished thermally, at a plurality of variously spaced and shaped points, by passing the SMS laminate through a nip between a heated engraved roll and a heated crowned anvil roll. The bond roll temperatures for the most clothlike performing mats at the specified 0.95 denier were found to require skewing by 40° F. (cooler on the anvil) to prevent the SB microfibers from being bonded secondarily to each other between the bond points. Secondary bonds were found to impart a significant stiffness to the mat and a harsh tactile feel. The secondary bonding, not seen at higher deniers, is caused by the increased fiber per unit area (web density) and reduced fiber mass characteristic of lower deniers. Heat transfer through the fiber and from fiber to fiber is much improved in this situation and therefore some melting and bonding occurs against the flat anvil roll which has a high level of fiber contact when compared to the patterned roll. With line speed as a constant in the equation, i.e. not a factor in reducing denier, then heat transfer improves at least as a function of the square of the reduced fiber thickness. A range of skewed anvil to pattern bond roll temps was trialed in the range of 0° to 50° F. (40° F. in this Example). Pattem temperatures were also raised to compensate for the reduced anvil temperature. Pattern roll temperatures were investigated in the range of 250°–300° F, (121°–149° C.) at the 300 fpm line speed held constant, while anvil temperatures were varied between 230° F. (110° C.) and 280° F.(138° C.). The required skew of bond roll temperatures for optimized properties was found to be dependent on at least raw materials, line speed, pin density, bond area, fiber structure and fiber size.

Once bonded, the mat was stretched within a range of 5–25% in the machine direction (MD) to separate fiber to fiber bonds not associated with specific bond points and to relax tension in fibers held tightly in between bond points. This technique was also found to allow fibers to move in the Z-direction, thus finding their own low order state and allowing more freedom of movement between bond points for those fibers whose length between bond points was greater than the minimum distance between the points. Slightly elevated temperatures from ambient conditions were found optimum at this step to protect barrier properties of the laminate. Temperatures were varied from 70°–200° F. (21°–93° C.) during the neck stretching step. The neck stretching step is accomplished by passing the mat between two sets of nipped calender rolls, the second set running faster than the initial set. The rolls may be heated or cooled as needed to achieve desired mat properties and dimensional stability.

EXAMPLE 2

Unnecking of the neck stretched fabric is achieved by transferring the neck stretched fabric to a Tenter frame, as described in detail hereinabove, and stretching the fabric in the cross direction to achieve a desired percentage of the original fabric width. Unnecking is preferably done at ambient temperature. The cooled mats are then wound into parent rolls.

TABLE 1 shows the experimental results achieved.

TABLE 1

| | SMS | SB | Softening Treatment | | | Cup Crush | Tensile |
|---|---|---|---|---|---|---|---|
| Sample ID | BW | Den. | S | C | B | Load/Energy | CD/MD |
| 1 | 1.6 | 3.0 | N | N | N | 240/4800 | 18/20 |
| 2 | 1.6 | 3.0 | N | Y | N | 200/3700 | 14/17 |
| 3 | 1.6 | 1.5 | Y | Y | N | 172/3253 | 20/29 |
| 4 | 1.6 | 1.0 | Y | Y | Y | 145/2900 | 25/36 |
| 5 | 1.4 | 1.5 | Y | Y | N | 121/2344 | 17/24 |
| 6 | 1.4 | 1.0 | Y | Y | Y | 114/2287 | 21/33 |

Key to TABLE 1 abbreviations:
SMS = laminate of spunbond-meltblown-spunbond layers
BW = basis weight (osy)
Den. = denier
Softening Treatment: S = neck stretched
C = crimp
B = bond roll treated
(temperature differential was 40° F.)
CD = cross direction
MD = machine direction Bond pattern pin density was also found to significantly impact both drape characteristics and tactile properties of the subject mats. As denier was reduced, the more abrasion-resistant mats which resulted allowed pattern roll pin density to be decreased, thus allowing greater freedom of movement of fibers between bond points and thus improved drape and greater freedom to customize tactile feel with bond pattern and density. Pin densities of 50–400 pins/sq.in. were investigated in the range of about 12–19% bond area.

Overall, the objectives of the experiments were met: cup crush (conformability) was improved without sacrificing strength. In the base case 1.6 osy SMS strength was enhanced by 50%, while cup crush was improved by 40% over the 3.0 denier, uncrimped, non-necked stretched, non-differentially bonded control sample.

What is claimed is:

1. A method of producing a fabric, comprising:

(a) providing at least one polymer resin capable of forming fibers;

(b) forming a plurality of fibers from said resin;

(c) crimping said fibers;

(d) forming a nonwoven fiber mat from said fibers;

(e) spot bonding said mat by passing said mat between a first bond roll and a second bond roll; and, (f) neck stretching said mat.

2. The method of claim 1, wherein said resin is a thermoplastic polymer selected from the group consisting of polyolefins, polyesters, polyamides, polyurethanes, copolymers and mixtures thereof.

3. The method of claim 1, wherein said fibers have a denier of less than about 3.0 dpf.

4. The method of claim 1, wherein said fibers have a denier of less than about 1.5 dpf.

5. The method of claim 1, wherein said fibers have a denier of less than about 1.0 dpf.

6. The method of claim 1, wherein said fibers are formed by a spunbond process.

7. The method of claim 1, wherein said mat is stretched to about 5% to about 40% beyond its original length.

8. The method of claim 7, wherein said mat is stretched to about 15% to about 25% beyond its original length.

9. The method of claim 1, wherein said crimping is achieved by directing a means for providing a stream of air onto said fibers after formation.

10. The method of claim 1, wherein said first bond roll is a pattern roll, said second bond roll is an anvil roll and said first and second bond rolls are heated to different temperatures.

11. The method of claim 10, wherein said pattern roll is heated to a higher temperature than said anvil roll.

12. The method of claim 10, wherein said temperature differential is in the range of from about 10° F. to about 50° F.

13. The method of claim 10, wherein said temperature differential is in the range of from about 15° F. to about 45° F.

14. A method of producing a fabric, comprising:

(a) providing at least one polymer resin capable of forming fibers;

(b) forming a plurality of fibers from said resin;

(c) crimping said fibers;

(d) forming a nonwoven fiber mat from said fibers; and, (e) neck stretching said mat.

15. The method of claim 14, wherein said resin is a thermoplastic polymer selected from the group consisting of polyolefins, polyesters, polyamides, polyurethanes, copolymers and mixtures thereof.

16. The method of claim 14, wherein said fibers have a denier of less than about 3.0 dpf.

17. The method of claim 14, wherein said fibers have a denier of less than about 1.5 dpf.

18. The method of claim 14, wherein said fibers have a denier of less than about 1.0 dpf.

19. The method of claim 14, wherein said fibers are formed by a spunbond process.

20. The method of claim 14, wherein said mat is stretched to about 5% to about 40% beyond its original length.

21. The method of claim 20, wherein said mat is stretched to about 15% to about 25% beyond its original length.

22. The method of claim 14, wherein said crimping is achieved by directing a means for providing a stream of air onto said fibers after formation.

23. The method of claim 14, wherein said first bond roll is a pattern roll, said second bond roll is an anvil roll and said first and second bond rolls are heated to different temperatures.

24. The method of claim 23, wherein said pattern roll is heated to a higher temperature than said anvil roll.

25. The method of claim 23, wherein said temperature differential is in the range of from about 10° F. to about 50° F.

26. The method of claim 23, wherein said temperature differential is in the range of from about 15° F. to about 45° F.

27. A method of producing a fabric, comprising:

(a) providing at least one polymer resin capable of forming fibers;

(b) forming a plurality of fibers having a denier less than 3.0 from said resin;

(c) forming a nonwoven fiber mat from said fibers;

(d) neck stretching said mat;

(e) spot bonding said mat by passing said mat between a first bond roll and a second bond roll; and (f) unnecking said mat.

28. The method of claim 27, wherein said resin is a thermoplastic polymer selected from the group consisting of polyolefins, polyesters, polyamides, polyurethanes, copolymers and mixtures thereof.

29. The method of claim 27, wherein said fibers have a denier of less than about 1.5 dpf.

30. The method of claim 29, wherein said fibers have a denier of less than about 1.0 dpf.

31. The method of claim 27, wherein said fibers are formed by a spunbond process.

32. The method of 27, wherein said mat is stretched to about 5% to about 40% beyond its original length.

33. The method of 27, wherein said mat is stretched to about 15% to about 25% beyond its original length.

34. The method of claim 27, wherein said first bond roll is a pattern roll, said second bond roll is an anvil roll and said first and second bond rolls are heated to different temperatures.

35. The method of claim 34, wherein said pattern roll is heated to a higher temperature than said anvil roll.

36. The method of claim 34, wherein said temperature differential is in the range of from about 10° F. to about 50° F.

37. The method of claim 34, wherein said temperature differential is in the range of from about 15° F. to about 45° F.

38. A method of producing a fabric, comprising:

(a) providing at least one polymer resin capable of forming fibers;

(b) forming a plurality of fibers from said resin;

(c) crimping said fibers;

(d) forming a nonwoven fiber mat from said fibers;

(e) forming a laminate by spot bonding said mat and a second nonwoven web by passing said mat and said web between a first bond roll having a bond pattern and a second anvil bond roll wherein said anvil roll is at least about 10° F. cooler than said bond pattern roll; and (f) neck stretching said laminate.

39. The method of claim 38, wherein said resin is a thermoplastic polymer selected from the group consisting of polyolefins, polyesters, polyamides, polyurethanes, copolymers and mixtures thereof.

40. The method of claim 38, wherein said crimping is achieved by directing a means for providing a stream of air onto said fibers after formation.

41. The method of claim 38, wherein said fibers have a denier of less than about 1.5 dpf.

42. The method of claim 38, wherein said fibers have a denier of less than about 1.0 dpf.

43. The method of claim 38, wherein said fibers are formed by a spunbond process.

44. The method of claim 43, wherein said mat is stretched to about 5% to about 40% beyond its original length.

45. The method of claim 43, wherein said mat is stretched to about 15% to about 25% beyond its original length.

46. The method of claim 38, wherein said first bond roll is a pattern roll, said second bond roll is an anvil roll and said first and second bond rolls are heated to different temperatures.

47. The method of claim 46, wherein said pattern roll is heated to a higher temperature than said anvil roll.

48. The method of claim 46, wherein said temperature differential is in the range of from about 10° F. to about 50° F.

49. The method of claim 46, wherein said temperature differential is in the range of from about 15° F. to about 45° F.

* * * * *

UNITED STATES PATENT AND TRADEMARK OFFICE

CERTIFICATE OF CORRECTION

PATENT NO. : 5,810,954

DATED : September 22, 1998

INVENTOR(S) : Rob L. Jacobs et al.

It is certified that error appears in the above-identified patent and that said Letters Patent is hereby corrected as shown below:

Column 1, Line 14, "pattem" should read -- pattern --
Column 2, Line 65, "paftemed" should read -- patterned --
Column 2, Line 67, "pattem" should read -- pattern --
Column 3, Line 49, "layers.are" should read -- layers are --
Column 3, Line 52, "pattem" should read -- pattern --
Column 4, Line 66, "dispursed" should read -- dispersed --
Column 6, Line 2, "Bomslaeger" should read -- Bornslaeger --
Column 9, Line 38, "pattem" should read -- pattern --
Column 11, Line 5, "crimpsanch" should read -- crimps/inch --
Column 11, Line 32, "Pattem" should read -- Pattern --
In the Title, and column 1, "Method of Forming a Fine Fiber Barrier Fabric with Improved Drape and Strength of Making Same" should read -- Method of Forming a Fine Fiber Barrier Fabric with Improved Drape and Strength --

Signed and Sealed this

Second Day of February, 1999

*Attest:*

*Attesting Officer*

*Acting Commissioner of Patents and Trademarks*